US006402121B1

(12) United States Patent
Marcon

(10) Patent No.: US 6,402,121 B1
(45) Date of Patent: Jun. 11, 2002

(54) APPARATUS FOR USE IN LAYING PANELS

(75) Inventor: Lionel Marcon, Saint-Brice-Sous-Foret (FR)

(73) Assignee: Pierre Grehal et Compagnie, Saint-Brice-Sous-Foret (FR)

( * ) Notice: Subject to any disclaimer, the term of this patent is extended or adjusted under 35 U.S.C. 154(b) by 0 days.

(21) Appl. No.: 09/628,065

(22) Filed: Jul. 28, 2000

(30) Foreign Application Priority Data

Jul. 29, 1999 (FR) ..... 99 09857

(51) Int. Cl.[7] ..... B66F 3/00
(52) U.S. Cl. ..... 254/11; 254/12
(58) Field of Search ..... 254/12, 14, 15, 254/16

(56) References Cited

U.S. PATENT DOCUMENTS 284,747 A * 9/1883 Margot ..... 254/12
308,811 A * 12/1884 Tayor ..... 254/12
769,076 A * 8/1904 Hammond et al. ..... 254/12
788,045 A * 4/1905 Hammond et al. ..... 254/12
1,005,038 A * 10/1911 Hubbard ..... 254/12
1,577,491 A 3/1926 Prentice
2,518,586 A * 8/1950 Williamson ..... 254/12
2,717,144 A 9/1955 Labuza
2,780,437 A 2/1957 Ham
3,524,623 A 8/1970 Campbell

* cited by examiner

*Primary Examiner*—Robert C. Watson
(74) *Attorney, Agent, or Firm*—Paul & Paul

(57) ABSTRACT

The device comprises fixation members to be fixed onto the batten, a rod selectively driven in translation with respect to the fixation members, parallely to the batten, a push member which is fixed onto one end of the rod, and driving members that are rigidly connected with said fixation members for driving the rod according to a longitudinal axis of the rod in an advance direction for which the push member is arranged before the rod. The fixation members comprise a cramp forming stirrup which is fitted with a screwable block for adapting a transverse size of the stirrup to the width of the batten, and a knuckle member for selectively fixing the stirrup on the batten.

16 Claims, 4 Drawing Sheets

APPARATUS FOR USE IN LAYING PANELS

FIELD OF THE INVENTION

The present invention generally relates to a device for aiding to lay a plurality of flooring panels on a set of battens.

More precisely, the invention relates to a device for aiding to lay flooring panels on a batten having a predetermined width, with these flooring panels being arranged transversally to this batten, this device comprising fixation members to be fixed onto the batten, a rod-selectively driven in translation with respect to the fixation members, parallely to the batten, a push member which is fixed onto one end of the rod, and driving members, rigidly connected with the fixation members, for driving the rod according to a longitudinal axis of the rod, in an advance direction for which the push member is arranged before the rod.

BACKGROUND OF THE INVENTION

Devices of this type are well known in the art, as this is shown for example in U.S. Pat. Nos. 1,618,896; 2,717,144; 3,524,623; 4,620,691 and in French patent 2,701,883.

The main problem raised by laying flooring panels is in the difficulty to apply the flooring panels, at two points that are spaced apart on their length, with balanced forces to guarantee a parallelism of the layed flooring panels, this problem being pratically insurmontable when the laying is made by only one operator.

Some of the known devices do not however aim to solve this problem, but only to enable application, on the flooring panels in the course of being layed, of a relatively high force by means of a relatively moderated physical effort.

Besides, although the device for example as described in U.S. Pat. No. 3,524,623 solves the above problem, this patent recommends to use, as fixation means, a set of prongs provided to enter the wood of the batten.

For facilitating the prongs to enter the wood, they are bent according to a direction which is opposite to the advance direction of the push member, so that they are provided to enter the wood of the batten when the force which is applied on the flooring panel in the course of being layed overpasses the resistance of the wood to penetration of these prongs.

It has however being shown that if the batten is made of a too soft wood, the prongs will have a tendency to tear the wood of the batten before the force, which is applied on the flooring panel in the course of being layed, will even be sufficient, and that, if the batten is made of a wood that is too hard, extracting of the prongs is particularly difficult.

PURPOSE AND SUMMARY OF THE INVENTION

In the above context, the invention aims in particular to provide a device for aiding to lay flooring panels, which aiding device overcomes the above compromise, while having a great easiness of use.

For this purpose, the device of the invention, which is besides in agreement with the generic definition as given above, is essentially characterized in that the fixation members comprise a cramp forming stirrup which is fitted with a screwable block for adapting a transverse size of the stirrup to width of the batten, and a knuckle member for selectively fixing the stirrup on the batten.

According to a preferred embodiment on the invention, the driving members comprise a clamp which is essentially formed of a first and a second levers that are substantially perpendicular to the rod and respectivelly arranged in a fixed and pivoting manner with resect to the stirrup, a driving pawl that is tiltingly mounted around a first transverse spindle which is fixed to the second lever and transmits to the rod, in the advance direction, a translation movement connected with a pivoting movement of the second lever, and a retaining pawl which is tiltingly mounted around a second transverse spindle which is fixed with respect to the stirrup, for preventing a movement of the rod in a direction that is opposite to the advance direction.

In this case, the first lever is preferably a cap shaped lever, and the second lever is pivotally mounted around a third transverse spindle, the first lever then supporting the second and third transverse spindles.

The rod, which may be provided with notches, has for example a substantially cylindrical outer surface, and is advantageously provided with notches only on an angularly limited area of its outer surface, the rod being possibly provided with a hook enabling to easily drive the rod in rotation around its longitudinal axis, and being thus possibly disconnected from the driving and retaining pawls.

The stirrup may be provided with first and second arms and with a base for connecting the first and second lateral arms together, the first lateral arm carrying the knuckle member.

For example, the knuckle member has a pushing spindle which crosses through the first lateral arm of the stirrup, while the screwable block is carried by the pushing spindle of the knuckle member, the second arm of the stirrup supporting one or a plurality of claws that are directed towards the first arm.

In a preferred embodiment of the invention, the stirrup, the clamp and the push member are formed by metal blanks that are cut and bent, and one end of the first lever is enlarged for forming a platten which is made to be rigidly connected with an outer face of the base of the stirrup.

The push member is preferably designed for forming, at a tip end of the rod, a reversed shovel able, to maintain a jig, if necessary.

The push member may moreover be mounted in a removable manner on the end of the rod so to be interchangeable, this push member being then also able to take the shape of a guiding tab which is extended at least partially in a plane that contains the longitudinal axis of the rod.

The push member is, for example, provided with cuts for delimiting transverse strips, with some of which at least being arranged on both sides of the rod and one of which coming into abutment on the end of the rod.

Lastly, the end of the rod may be provided with a shoulder that is positionned in one of the cuts so to elastically deform one at least on the transverse strips when the push member is threaded on the rod.

These and other features of the subject invention will be more readily apparent from the following detailed description of the invention taken in conjunction with the drawings.

BRIEF DESCRIPTION OF THE DRAWINGS

So that one skilled in the art to which the subject invention appertains will better understand how to employ the invention, preferred embodiments thereof will be described hereinbelow with reference to the drawings, wherein.

DETAILED DESCRIPTION OF THE PREFERRED EMBODIMENTS

Figure 1:
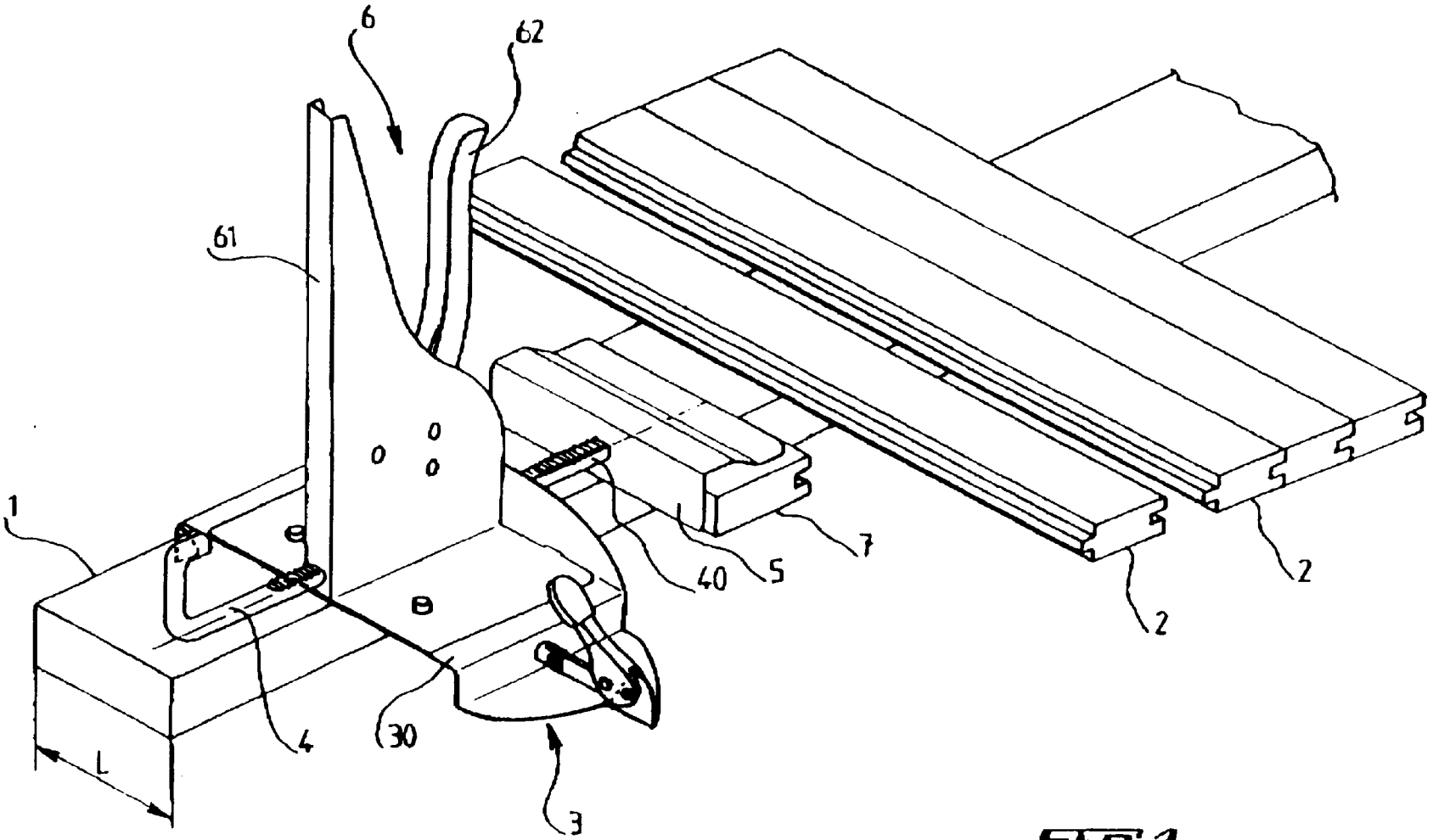
FIG. 1 is a general perspective view of a device according to the invention, in the course of being used, the distance between the jig and the flooring panel to be layed, as well as the distance between the flooring panel to be layed and the flooring panels that have already been layed, being extended for permitting a better understanding of the figure.

As this is better shown in FIG. 1, the invention relates to a device provided for facilitating a laying of flooring panels 2 on a set of battens 1, the flooring panels 2 being arranged transversally to the battens 1.

The inventive device generally comprises fixation members 3 for fixing the device on a batten 1, a rod 4, a push member 5 which is fixed, preferably in a removable manner, onto one end 40 of the rod 4, and driving members 6 for driving the rod 4 according to a longitudinal axis X (FIG. 3) and in an advance direction A.

The driving member 6 are rigidly connected with the fixation members 3, which fixation members 3 are themselves rigidly connected, in use, with the batten 1, the rod 4 being driven into translation along the batten 1.

Figure 2:
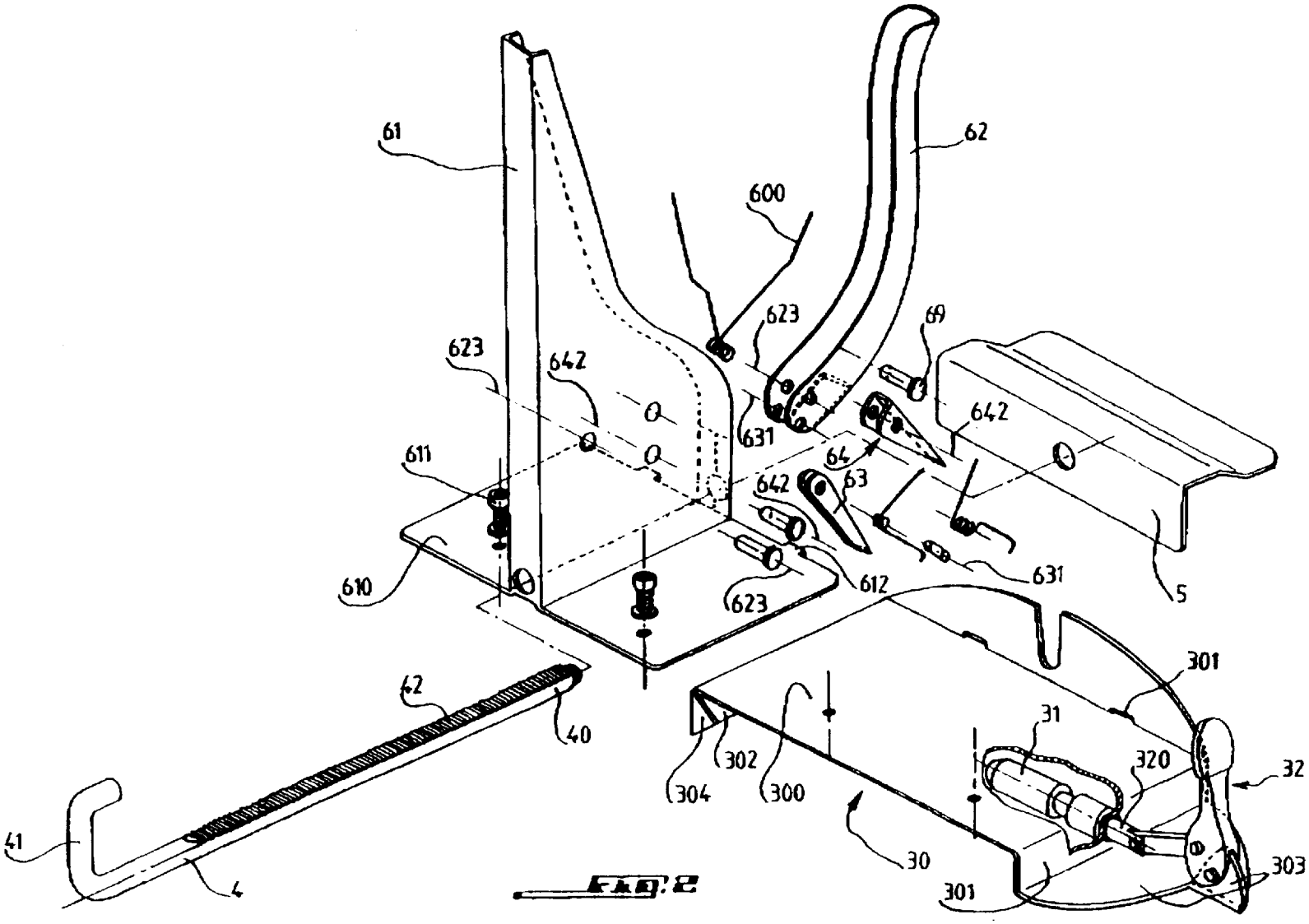
FIG. 2 is an exploded perspective view of the device shown in FIG. 1.

According to a first aspect of the invention, the fixation members 3 comprise a cramp forming stirrup 30 (FIG. 2 and 3), fitted with a screwable block 31 for adapting a transverse size of the stirrup 30 to width L of the batten 1, and a knuckle member 32 enabling to rapidly secure the stirrup 30 onto the batten 1 and also to remove it rapidly therefrom.

By "knuckle member ", there is meant here any locking mechanism with a cam or a lever, working on the well known principle of the overpassed dead point, also known under the name of the "toggle" principle.

Besides, the driving members 6 essentially comprise a clamp 60, a driving pawl 63, and a retaining pawl 64, the clamp 60 being principally formed of two levers 61, 62 that are arranged practically at right angle with respect to the rod 4, with the first layer 61 being fixedly mounted with respect to the stirrup 30.

The stirrup 30, the clamp 60, and the push member 5 are preferably formed by metal flanks that are cut and bent.

In the above case, it is easy to provide that the fixed lever 61 will be cap shaped and have one end which is enlarged, thanks to a fold, for forming a platen 610.

The platen 610 may itself be rigidly connected with the outer face of the base 300 of the stirrup 30, for example by means of screws such as shown at 611, and lugs such as shown at 612 and which are engaged into apertures such as shown at 301 in the base 300 of the stirrup 30.

The second lever 62 may also be pivotaly mounted around a transverse stirrup 623 which is supported by the cap constituted by the fixed lever 61, an helical spring 600 being coiled on this spindle 623 for elastically spacing the lever 62 from the fixed lever 61 and pushing the lever 62 against a transverse abutment 69.

Figure 3:
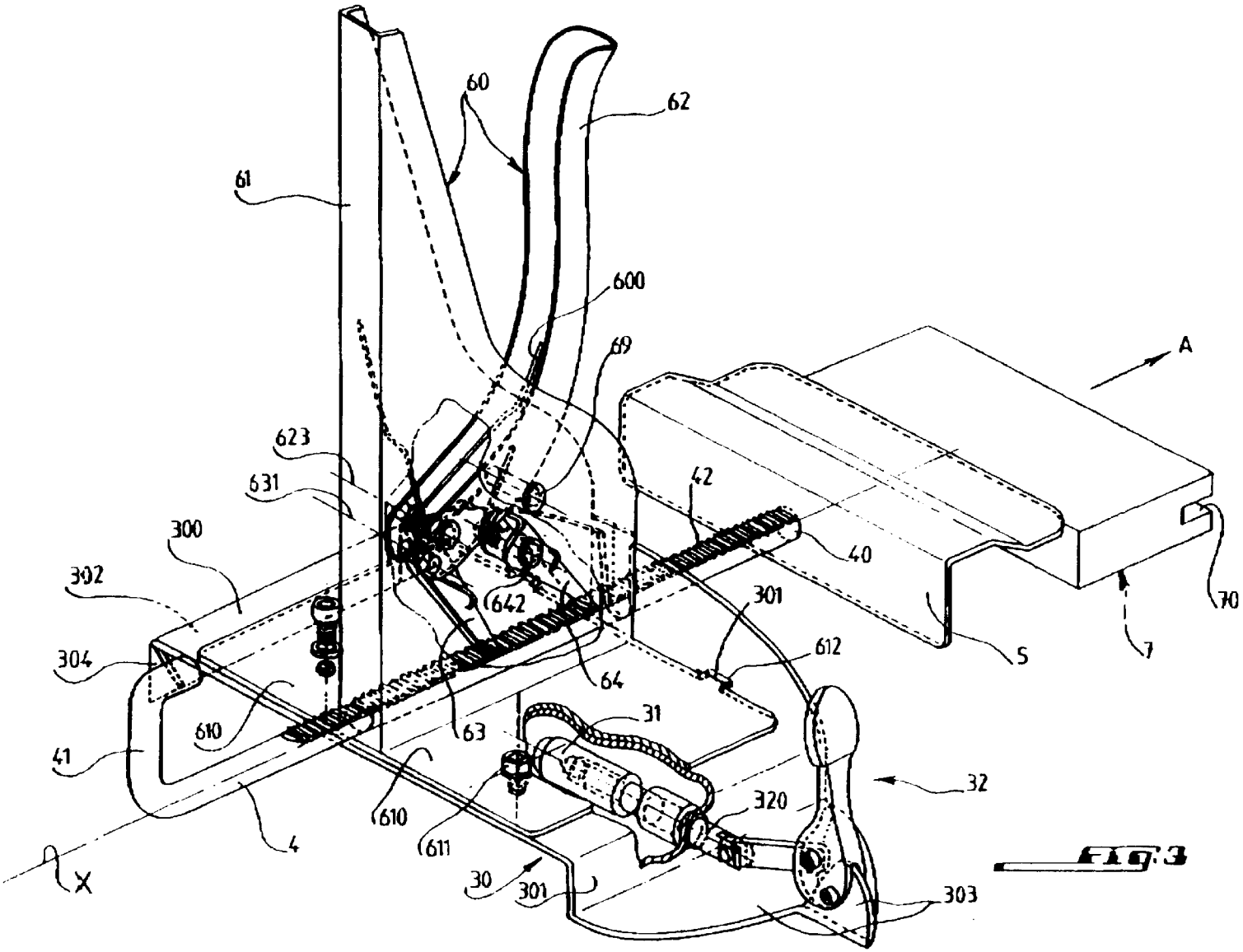
FIG. 3 is a perspective view of the device shown in FIG. 2, after assembling.

As this is well shown in FIG. 3, the rod 4 is preferably provided with notches, but preferably only on an angularly restricted area of its outer surface, this surface being moreover essentially a cylindrical surface.

The driving pawl 63 is tiltingly mounted around a transverse spindle 631 which is fixed onto one end of the lever 62 for transmitting to the rod 4, in the advance direction A, a translation movement linked with the pivoting movement of the second lever 62 around the spindle 623.

The retaining pawl 64 is tiltingly mounted around a transverse spindle 642 carried by the cap constituted by the fixed lever 61, the function of the retaining pawl 64 being to prevent any movement of the rod 4 in a direction that is opposite to the advance direction A.

Each of the pawls 63 and 64 is elastically biased toward the rod 4 thanks to a suitable helical spring that is for example coiled on the spindle of the relative pawl.

The rod 4 is guided in translation against the outer face of the base 300 of the stirrup 30, or at the vicinity thereof, at the side of the end of the fixed lever 61 which is shaped as a platen, and so as to be driven in rotation around its longitudinal axis X.

This rod 4 is besides preferably hook shaped at its end 41 which is remote from the push member 5, so as to facilitate its driving in rotation around the axis X, thanks to which the notches 42 of the rod 4 will escape from the pawls 63 and 64, and thanks to which the rod 4 may therefore be freely moved with respect to the stirrup 30.

The push member 5 which is mounted at the end 40 of the rod 4 may have the shape of a reversed shovel, so as to maintain, if necessary, a jig 7 the front part 70 of which is adapted to the contour of the flooring panel, in case this flooring panel is directed in a way so that a pressure that is directly exerted thereon by the push member would risk to damage the flooring panel.

The stirrup 30 is globally "U" shaped, and is formed by two lateral arms 301, 302 that are connected together by the base 300 of the stirrup 30.

The first arm 301 is for example provided with a lug 303 on which the knuckle member 32 is articulated.

The knuckle member 32 is also provided with a pushing spindle 320 which passes through the first lateral arm 301 of the stirrup 30, and which may be threaded for carrying a nut able to form the screwable block 31.

To complete a maintaining of the stirrup 30 on the batten 1, the other arm 302 of the stirrup 30 supports advantageously two claws, such as shown at 304, which claws 304 are directed according to a transverse direction and aimed towards the first arm 301.

Although the push member 5 may be riveted onto the end 40 of the rod 4, the push member 5 is preferably mounted in a removable manner onto the rod 4, possibly by means of a screw.

Figure 4:
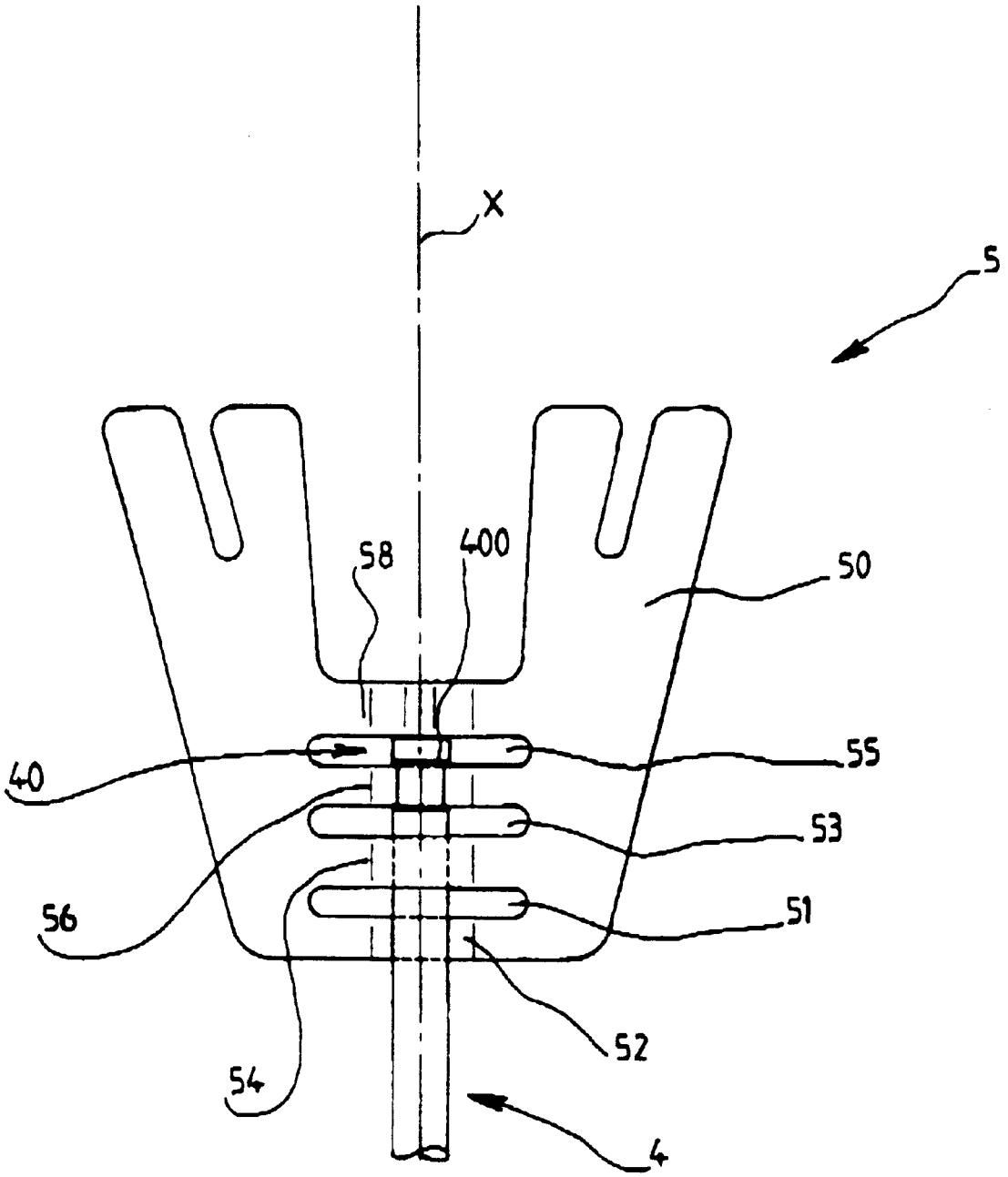
FIG. 4 is a top view of the rod fitted with a push member of an other type.

Moreover, as this is shown in FIG. 4, the push member 5 may have various shapes and, in particular, the shape of a guiding tab 50 which is extended at least partially in a plane that contains the longitudinal axis X of the rod 4, and which is enlarged at a distance from the end 40 of the rod 4.

As this is besides shown in FIG. 4, the push member 5 may be provided with cuts, such as shown at 51, 53 and 55, which cuts are forming a set of transverse strips, such as shown at 52, 54, 56, 58, which strips are used for the removable mounting of the push member 5 on the rod 4.

More precisely, some of these strips, such as shown at 52, 54 and 56, are arranged of both sides of the rod 4, and one of these strips, such as shown at 58, comes into abutment on the end 40 of the rod 4.

Preferably, the end 40 of the rod 4 is provided with a relief, such as a shoulder 400, which is positionned in one 55 of the cuts, and which elastically deforms one at least of the transverse strips, such as the strip 56, when the push member 5 is threaded on the rod 4.

it will lastly be noted that the invention is not restricted to the hereabove described embodiment.

Actually, it is possible to provide the fixation means 3 with means for adjusting the length of the screwable block 31 in order to adapt this block to the width of the batten 1. For example, these adjusting means are provided as a set of screws each adapted for the mounting of the screwable block 31, these screws having specific lengths and each being chosen in function of the width of the battens capable of receiving the aiding device of the invention.

Besides, it is also possible to provide, on the constituent wall of the push member 5, a set of holes (not shown) enabling a fixation, for example by screwing, of said jig 7 through which the push member 5 will exert an effort on the flooring panels 2.

Lastly, the shape of the push member 5 is preferably adapted to the type of flooring panels to be mounted, i.e. either tongued or grooved.

What is claimed is:

1. A device for aiding to lay flooring panels on a batten (1) of a predetermined width (L), said flooring panels (2) being arranged transversally to said batten, the device comprising fixation members (3) to be fixed onto said batten, a rod (4) selectively driven in translation with respect to said fixation members (3), parallel to said batten (1), a push member (5) which is fixed onto one end (40) of said rod (4), and driving members (6) that are rigidly connected with said fixation members (3) for driving said rod (4) according to a longitudinal axis (X) of said rod in an advance direction (A) for which said push member is arranged before said rod, wherein said fixation members (3) comprise a clamp forming stirrup (30) which is fitted with a screwable block (31) for adapting a transverse size of said stirrup to said width (L) of said batten (1), and a knuckle member (32) for selectively fixing said stirrup (30) on said batten (1).

2. The aiding device as set forth in claim 1, wherein the driving members (6) comprise a clamp (60) which is comprised of a first and second levers (61,62) that are substantially perpendicular to said rod (4) and respectively arranged in a fixed and pivoting manner with respect to said stirrup (30), a driving pawl (63) that is tiltingly mounted around a first transverse spindle (631) which is fixed to said second lever (62) and transmits to said rod (4), in said advance direction (A), a translation movement connected with a pivoting movement of said second lever (62), and a retaining pawl (64) which is tiltingly mounted around a second transverse spindle (642) which is fixed with respect to the stirrup (30) for preventing said rod (4) to move in a direction that is opposite to said advance direction (A).

3. The aiding device as set forth in claim 2, wherein said first lever (61) is a lever having a perpendicular cap area forming the plateau (610), said second lever (62) is pivotally mounted around a third transverse spindle (623), said first lever (61) then supporting said second and third transverse spindles (642, 623).

4. The aiding device as set forth in claim 1, wherein said rod (4) is provided with notches.

5. The aiding device as set forth in claim 4, wherein said rod (4) has a substantially cylindrical outer surface, is provided with notches on said outer surface, and is drivable in rotation around its longitudinal axis (X).

6. The aiding device as set forth in claim 1, wherein said stirrup (30) has first and second lateral arms (301, 302) and is provided with a base (300) for connecting said first and second lateral arms (301, 302) together, and wherein said first lateral arm (301) carries said knuckle member (32).

7. The aiding device as set forth in claim 2, wherein said stirrup (30) is provided is with a base (300), said base having an outer face, and wherein one end of said first lever (61) is enlarged for forming a platten (610) which is rigidly connected with said outer face.

8. The aiding device as set forth in claim 2, wherein said stirrup (30), clamp (60) and push member (5) are formed by metal flanks that are cut and bent.

9. The aiding device as set forth in claim 6, wherein said knuckle member (32) is provided with a pushing spindle (320) that passes through said first lateral arm (301) of said stirrup (30), wherein said screwable block (31) is carried by said pushing spindle, and wherein said second arm (302) of said stirrup (30) supports at least one claw (304) directed towards said first arm (301).

10. The aiding device as set forth in claim 1, wherein said screwable block (31) has a given length, and wherein said fixation members (3) comprise means for adjusting said given length of said screwable block (31) in order to adapt said screwable block (31) to said width (L) of said batten (1).

11. The aiding device as set forth in claim 1, wherein said rod (4) has one tip end, and wherein said push member (5) is shaped, at said tip end to selectively maintain a jig (7).

12. The aiding device as set forth in claim 1, wherein said rod (4) has one end (40), and wherein said push member (5) is removably mounted on said one end.

13. The aiding device as set forth in claim 11, comprising fixation means of said jig (7) on said push member (5).

14. The aiding device as set forth in claim 1, wherein said push member (5) is shaped as a guiding tab (50) which is extended at least partially in a plane that contains a longitudinal axis for said rod (4).

15. The aiding device as set forth in claim 1, wherein said push member (5) is provided with cuts (51, 53, 55) for delimiting transverse strip (52, 54, 56, 58), some (52, 54, 56) of which at least being arranged on both sides of said rod (4) and one of which (58) coming into abutment on one end (40) of said rod (4).

16. The aiding device as set forth in claim 15, wherein said rod (4) has one end (40) which is provided with a shoulder (400), said shoulder being positioned in one of said cuts and elastically deforming one at least of said transverse strips when said push member (5) is threaded on said rod (4).

* * * * *